United States Patent [19]

Yabe et al.

[11] 4,116,692

[45] Sep. 26, 1978

[54] PHOTOGRAPHIC METHOD UTILIZING A PHOTOSENSITIVE COMPOSITION CONTAINING A 2-AZIDOBIPHENYL AND A TRIPLET SENSITIZER

[75] Inventors: Akira Yabe, Fujisawa; Koichi Honda, Tokyo, both of Japan

[73] Assignee: Agency of Industrial Science & Technology, Tokyo, Japan

[21] Appl. No.: 776,896

[22] Filed: Mar. 11, 1977

[30] Foreign Application Priority Data

Jun. 7, 1976 [JP] Japan ..... 51-066257

[51] Int. Cl.[2] ..... G03C 5/04; G03C 1/58; G03C 1/52

[52] U.S. Cl. ..... 96/27 E; 96/49; 96/91 N

[58] Field of Search ..... 96/49, 27 R, 27 E, 91 N, 96/115 R, 115 P

[56] References Cited

U.S. PATENT DOCUMENTS

| | | | |
|---|---|---|---|
| 2,690,968 | 10/1954 | Powers | 96/91 N |
| 3,676,132 | 7/1972 | Scheler et al. | 96/49 |
| 3,716,367 | 2/1973 | Ando | 96/91 N |
| 3,844,793 | 10/1974 | Singh | 96/49 |

OTHER PUBLICATIONS

Swenton, et al.: "Interaction of Aromatic Hydrocarbon Excited Singlet States with 2-Azidobiphenyl" Chem. Communications, 1969, 1263–1264.

*Primary Examiner*—Won H. Louie, Jr.
*Attorney, Agent, or Firm*—Armstrong, Nikaido, Marmelstein & Kubovcik

[57] ABSTRACT

A photosensitive composition comprising 2-azidobiphenyl or its derivative and a triplet sensitizer produces a stable image by irradiation.

Both of coloring and fixing are conducted by irradiating with light of different spectral distributions.

5 Claims, No Drawings

PHOTOGRAPHIC METHOD UTILIZING A PHOTOSENSITIVE COMPOSITION CONTAINING A 2-AZIDOBIPHENYL AND A TRIPLET SENSITIZER

BACKGROUND OF THE INVENTION

Hereinbefore, there have been widely used various photosensitive compositions for the formation of images in which photosensitive components are silver salts or non-silver salt compounds.

In using such a conventional photosensitive composition, the formation of images is usually conducted by wet developing treatment, dry developing treatment or printing out treatment and the subsequent fixing is usually conducted by wet method using fixing solutions. These conventional photographic processes have such disadvantages that many steps, various chemical agents, equipments and much time are required.

An object of the present invention is to solve such conventional disadvantages.

An other object of the present invention is to provide a novel photosensitive composition.

A further object of the present invention is to provide a novel photosensitive composition which can be colored and fixed by utilizing separatedly direct photodegradation and photosensitization.

The foresaid objects and other objects and advantages of the present invention will become more apparent from the following description.

SUMMARY OF THE INVENTION

The objects of the present invention are achieved by preparing a composition comprising 2-agidobiphenyl or its derivative and a triplet sensitizer.

PREFERRED EMBODIMENT OF THE INVENTION

The photosensitive composition of the present invention is irradiated with light of a selected spectral distribution to produce a deep colored image and then irradiated all over with light of different spectral distribution to change the color of non-irradiated portion to a light-color and thereby a stable image can be obtained or fixed.

In the photosensitive composition of the present invention, 2-azidobiphenyl or its derivative, a main photosensitive component, is used together with a triplet sensitizer. In order to make films therefrom, various polymers may be used as binders.

2-Azidobiphenyl and its derivatives used as main photosensitive components are shown by the following general formula:

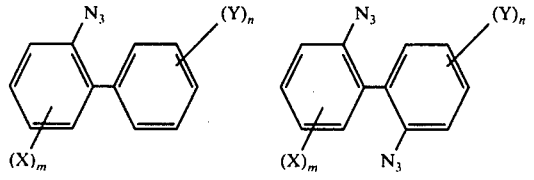

wherein X and Y represent substituents, for instance, hydrocarbon group such as methyl, ethyl or propyl, acyl group, alkoxy group, sulfonic acid group, carboxyl group, cyano group, amino group, nitro group or halogen atom, *m* and *n* represent integers from 0 to 4.

It is possible to change the colors of image by varying substituents.

As triplet sensitizers, any kind of triplet sensitizers may be used. Among them, aromatic carbonyl compounds such as benzophenone, acetophenone, 3-methoxy acetophenone, 4-phenyl acetophenone and xanthone are more preferably used.

As binders to make film from the photosensitive composition of the present invention, any kind of polymers, which can well disperse 2-azidobiphenyl or its derivative and the sensitizer and can make film, may be used. Among them, vinyl polymers such as polyvinylalcohol, polyvinylacetate and polymethylmethacrylate are more preferably used.

2-Azidobiphenyl or its derivative and the triplet sensitizer are preferably used in the almost same amounts. The preferable amounts of them are about 1 to about 30% by weight, more preferably about 5 to about 20% by weight based on the polymer composition, respectively.

To obtain a colored image, the photosensitive composition of the present invention is irradiated with light containing mainly wavelength of more than about 280 nm to produce a yellowish orange colored azo compound due to bimolecular reaction of 2-azidobiphenyls.

Light used for such coloring preferably contains light of the long wavelength of more than about 280 nm as much as possible. In order to obtain such light, the irradiation may be conducted through a filter or a monochromator. Preferable light sources for this coloring purpose are high pressure mercury arc lamps, high pressure xenone lamps, tangsten lamps and the like.

To fix the image after the above mentioned irradiation, the photosensitive composition of the present invention is irradiated wholly with light containing mainly wave length of less than about 280 nm to decompose the remaining unreacted 2-azidobiphenyls. Preferable light sources for this fixing purpose are low pressure mercury arc lamps, medium pressure mercury arc lamps and the like.

After the unirradiated part of the photosensitive composition is reacted to light, the stable image can be obtained.

The irradiation time or the exposure time can be readily determined depending on the kind of main photosensitive component, the concentration thereof, the kind of light source and other factors, however, usually, a few seconds to a few minutes are sufficient.

According to the present invention, a stable image can be easily obtained by using quite simple process. In comparison with conventional wet fixing treatments, the developing and fixing steps are remarkedly simplified in the present invention.

In the present invention, utilizing one light source and filters, the coloring (simultaneous exposure and developing) and the fixing may be conducted continuously and rapidly.

The present invention is explained in detail by way of the following examples.

EXAMPLE 1

Into 100 ml of cyclohexanone solution containing 5% of polymethylmethacrylate, 1 gr of 2-azidobiphenyl and 1 gr of benzophenone were dissolved. The solution thus obtained was coated on a dry glass plate and the solvent was sufficiently evaporated off. An image mask was placed closely on the film obtained and then the irradiation was conducted for about 20 seconds through a filter "UV-31" manufactured by Toshiba Co. from a 500W high pressure mercury arc lamp.

After the mask was torn off, all over the film was irradiated for about 2 minutes by using a low pressure mercury arc lamp.

The irradiated part when the mask was used became yellowish orange color and the remaining part became light yellow color and thereby a sharp image was obtained.

EXAMPLE 2

Into 100 ml of cyclohexanone solution containing 5% of polymethylmethacrylate, 1 gr of 2,2'-diazidobiphenyl and 1 gr of xanthone were dissolved.

The solution thus obtained was coated on a dry glass plate and the solvent was sufficiently evaporated off. An image mask was placed closely on the film and the irradiation was conducted for about 30 seconds through a filter "UV-31" manufactured by Toshiba Co. from a 500W high pressure mercury arc lamp. After the mask was torn off, all over the film was irradiated for about 2 minutes by using a low pressure mercury arc lamp.

The irradiated part when the mask was used became brown color and the remaining part became yellow color.

EXAMPLE 3

Into 100 ml of ethyl alcoholmethyl ethyl ketone (1 : 1) solution containing 5% of polyvinylacetate, 1 gr of 2-azido-2'-methyl biphenyl and 1 gr of benzophenone were dissolved.

Uning the solution thus obtained as a photosensitive solution, the experiment was conducted in the same manner as in Example 1 to obtain the same image.

EXAMPLE 4

Into 100 ml of ethyl alcohol-methyl ethyl ketone (1:1) solution containing 5% of polyvinylacetate, 1 gr of 2-azido-3'-methoxy biphenyl and 1 gr of benzophenone were dissolved. The solution thus obtained showed the same photosensitive effect as in Example 1.

EXAMPLE 5

Into 100 ml of ethyl alcohol-water (1 : 1) solution containing 5% of polyvinylalcohol, 1 gr of 2-azido-4'-hydroxy biphenyl and 1 gr of benzophenone were dissolved. The solution thus obtained showed the same photosensitive effect as in Example 1.

What is claimed is:

1. A method for obtaining a stable image on a photosensitive coating of a composition containing at least a main photosensitive component, an aromatic carbonyl triplet sensitizer in a sensitizing amount triplet sensitizer and a polymer as binder, comprising forming the image on the photosensitive coating through imagewise expasing onto the coating a light of a certain wave length, followed by fixing the image through uniformly exposing the coating containing said image with a light of a wave length different from said certain wave length, said main photosensitive component comprising at least a compound selected from the group consisting of a 2-azidobiphenyl and a derivative thereof represented by the following formulas:

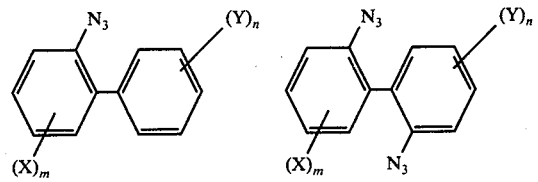

wherein X and Y represent the same or different substituents, *m* and *n* represent integers of 0 to 4.

2. The method of claim 1 wherein X and Y are selected from methyl, ethyl, propyl, acyl, alkoxy, sulfonic acid, carboxyl, cyano, amino, nitro and halogen groups.

3. The method composition according to claim 1 in which the triplet sensitizer is selected from the group consisting of benzophenone, acetophenone, 3-methoxy acetophenone, 4-phenyl acetophenone and xanthone.

4. The method according to claim 1 in which the polymer is selected from the group consisting of polyvinylalcohol, polyvinylacetate and polymethylmethacrylate.

5. The method according to claim 1 in which said 2-azidobiphenyl and the triplet sensitizer are contained about 1 to about 30% by weight, respectively.

* * * * *